US006778677B2

(12) United States Patent
Coffin

(10) Patent No.: US 6,778,677 B2
(45) Date of Patent: Aug. 17, 2004

(54) REPAIRABLE ELECTROMAGNETIC LINEAR MOTOR FOR LOUDSPEAKERS AND THE LIKE

(76) Inventor: C. Ronald Coffin, 18 John's La., Topsfield, MA (US) 01983

( * ) Notice: Subject to any disclaimer, the term of this patent is extended or adjusted under 35 U.S.C. 154(b) by 0 days.

(21) Appl. No.: 10/408,513

(22) Filed: Apr. 7, 2003

(65) Prior Publication Data

US 2004/0013283 A1 Jan. 22, 2004

Related U.S. Application Data

(63) Continuation-in-part of application No. 10/196,451, filed on Jul. 16, 2002, now abandoned.

(51) Int. Cl.[7] ..... H04R 25/00

(52) U.S. Cl. ..... 381/418; 381/417; 381/401

(58) Field of Search ..... 381/396, 400, 381/401, 405, 417, 418, 432, 182, 186, 412, 423; 310/81

(56) References Cited

U.S. PATENT DOCUMENTS

| | | | | | |
|---|---|---|---|---|---|
| 2,245,511 | A | * | 6/1941 | Turnbull, Jr. et al. | 381/418 |
| 2,381,673 | A | * | 8/1945 | Lehde | 381/418 |
| 2,890,289 | A | * | 6/1959 | Carrell | 381/418 |
| 4,000,381 | A | * | 12/1976 | Plice et al. | 381/418 |
| 4,256,930 | A | | 3/1981 | Garner et al. | |
| 4,752,602 | A | | 6/1988 | Thiele et al. | |
| 5,022,084 | A | * | 6/1991 | Shinjo | 381/152 |
| 5,220,612 | A | * | 6/1993 | Tibbetts et al. | 381/328 |
| 5,802,189 | A | | 9/1998 | Blodget | |
| 2003/0002696 | A1 | | 1/2003 | Mazarakis | |

* cited by examiner

*Primary Examiner*—Huyen Le
(74) *Attorney, Agent, or Firm*—George A. Herbster

(57) ABSTRACT

An electronic linear motor particularly for use with loudspeakers includes first and second annular counterfacing air gaps centered on a motor axis. An armature and spider carry first and second voice coils in the first and second annular air gaps, respectively. A rigid link connects the armature and an output device, such as a loudspeaker cone. A releasable coupling attaches either or both ends of the rigid link to an adjacent armature or output device.

23 Claims, 8 Drawing Sheets

REPAIRABLE ELECTROMAGNETIC LINEAR MOTOR FOR LOUDSPEAKERS AND THE LIKE

CROSS-REFERENCE TO RELATED APPLICATION

This application is a continuation-in-part of U.S. patent application Ser. No. 10/196,451, filed Jul. 16, 2002 (now abandoned) for an Electro-Magnetic Linear Motor for Loudspeakers and the Like.

BACKGROUND OF THE INVENTION

1. Field of the Invention

This invention generally relates to electromagnetic linear motors and more specifically to such motors adapted for use with electro-acoustical transducers such as loudspeakers.

2. Description of Related Art

Electromagnetic linear motors produce reciprocating motion along an axis in response to alternating current signals applied to a coil structure lying in a magnetic air gap. The amplitude of such alternating current signals causes the coil to reciprocate in the air gap. There are a wide variety of applications for such electromagnetic linear motors.

Loudspeakers represent one application in which electromagnetic linear motors drive loudspeaker cones. In such applications permanent magnets mount on a motor frame with pole pieces to define an annular magnetic air gap. A voice coil assembly on a bobbin or like structure to position a voice coil in the magnetic air gap attaches to the speaker cone. An alternating current signal applied to the voice coil oscillates or reciprocates the voice coil assembly and the attached loudspeaker cone along a loudspeaker axis. The resulting speaker cone vibrations should vary in accordance with the frequency and amplitude of the applied alternating current signal for accurate sound reproduction.

In recent years it has become desirable to increase the power ratings for loudspeakers in order to produce sound that more closely matches an input signal by minimizing distortion and improving frequency response particularly in the bass frequency range. One approach is building loudspeakers that are physically larger and use larger electromagnetic linear motors. As these motors become larger, they become more expensive to manufacture. Moreover, the availability of components for loudspeaker motors that utilize coil sizes greater than approximately four inches is limited because such components, particularly large magnets and pole pieces, are difficult to manufacture for loudspeaker applications.

Some loudspeakers now use dual tandem voice coils in an attempt to increase power capacity. In these loudspeakers a common bobbin carries two voice coils that ride in two annular magnetic air gaps. These voice coils are stated to operate in a push-pull configuration. It is also stated that the two-segment voice coils allow a high excursion with accuracy and controlled motion.

Other constructions for increasing the power capability of loudspeakers also involve two different voice coils. For example U.S. Pat. No. 5,740,265 (1998) to Shirakawa discloses a loudspeaker unit with a magnet system having dual magnetic air gaps and a vibratory system formed with a cylindrical voice coil bobbin carrying first and second voice coils for use in the dual magnetic gaps respectively. U.S. Pat. No. 5,748,760 (1998) to Button discloses a similar structure in which a magnetic structure includes a neodymium magnet and corresponding pole structures to define an elongated air gap that interacts with two voice coils.

Dual voice coils have also been used for other purposes. For example U.S. Pat. No. 4,176,249 (1979) to Inanaga et al. discloses a loudspeaker with a first magnet structure and voice coil for driving a speaker cone. A second magnet drive and independent voice coil eliminate the effect of reaction forces. U.S. Pat. No. 5,828,767 (1998) to Button discloses a loudspeaker with dual voice coils and a single short-circuited braking coil of one or more turns mounted on the voice coil form midway between the two voice coils. Whenever the voice coil assembly displacement approaches a working limit in either direction, the braking coil enters a corresponding one of two magnetic air gaps and limits motion.

U.S. Pat. No. 4,692,999 (1987) to Frandsen discloses a multi-coil, multi-magnet actuator for reciprocating a read/write head mechanism in a magnetic disk storage system as another electromagnetic linear motor application. In this actuator a bobbin carries two coils in two magnetic fields. This structure constitutes a voice coil motor, or solenoid, in which the two coils are oppositely wound to interact with oppositely directed magnetic fields.

In such electromagnetic linear motors it is important that a voice coil or bobbin not contact any of the magnetic pole pieces defining the magnetic air gap. This is especially difficult in loudspeakers constructed to allow large voice coil excursions in the air gap. In these situations it is necessary either to constrain the motion of the voice coil or to increase the air gap to accommodate any motion of the voice coil bobbin off a central axis. However, prior art approaches introduce other issues. For example, the U.S. Pat. No. 5,740,265 employs spiders proximate each end of the voice coil. While such structures may provide proper alignment, they introduce complexities in the design and assembly of component parts and increase manufacturing costs for such electromagnetic linear motors.

Loudspeakers can be subject to electrical and mechanical failures. For example, voice coils are subject to heating during use. Over time it is possible for the insulation between adjacent turns of a voice coil to melt thereby partially or completely short circuiting the voice coil. Such short circuits change the voice coil impedance and operating characteristics or produce a complete voice coil failure.

Likewise the electrical leads from terminals on a loudspeaker frame to the voice coils are subject to fatigue and breakage due to constant reciprocal motion. If the break occurs close to the voice coil, it may be difficult to repair the voice coil. Heat generated during operation can soften adhesive that bonds the coils to each other and the bobbin, so mechanical forces in the individual windings may then pull the windings apart and off the bobbin. Sometimes dirt in magnetic air gaps creates an undesirable rubbing noise as the coil moves in the air gap. Over time suspension components can become worn and sag, also creating a rubbing action. A speaker cone or diaphragm may become damaged due to water absorption, a physical puncture, or long term stress failure. In recent years it has become an object of certain competitions to produce as much sound pressure as possible from loudspeakers installed in an automobile. These operations are abusive to the loudspeakers and often lead to any of the foregoing.

Conventional loudspeakers generally have integral structures or substructures that make loudspeaker repairs from any one or more of the foregoing failures difficult. Anyone of the foregoing or other failures can only be repaired by requiring a disassembly and reassembly process that is difficult, complex and time consuming. Consequently in many cases loudspeakers that fail are merely replaced at significant expense even though a number of components of the failed loudspeaker are still viable.

Often times it would be desirable to retrofit improved parts that were not available when a speaker was purchased or to exchange components, such as coil assemblies, to convert the speaker from one electrical impedance to another. This would afford the speaker hobbyist or professional the opportunity of fine tuning a speaker for a particular application. However, the same restrictions that preclude repair often preclude such retrofittings or customizations. What is needed is a loudspeaker constructed to facilitate the disassembly, repair and reassembly for replacing defective components or for retrofitting or customizing certain components.

SUMMARY

Therefore it is an object of this invention to provide an electro-mechanical linear motor that can be readily disassembled and reassembled.

Another object of this invention is to provide a loudspeaker that can be readily disassembled and reassembled for repair, retrofit or customization.

Still another object of this invention is to provide a loudspeaker system with a dual-magnet, dual-voice coil electromagnetic linear motor that can be readily disassembled and assembled for repair, retrofit or customization.

In accordance with this invention a loudspeaker comprises a loudspeaker basket that suspends a loudspeaker cone for displacement along a loudspeaker axis. A motor frame with a magnet structure defines an annular magnetic air gap centered on the loudspeaker axis. An armature supports the voice coil for axial motion in the annular magnetic air gap. A rigid link extends between the armature and the loudspeaker cone. One end of the rigid link attaches to an adjacent one of the armature and loudspeaker cone by a releasable coupling whereby the rigid link can be detached from the adjacent one of the armature or loudspeaker cone.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
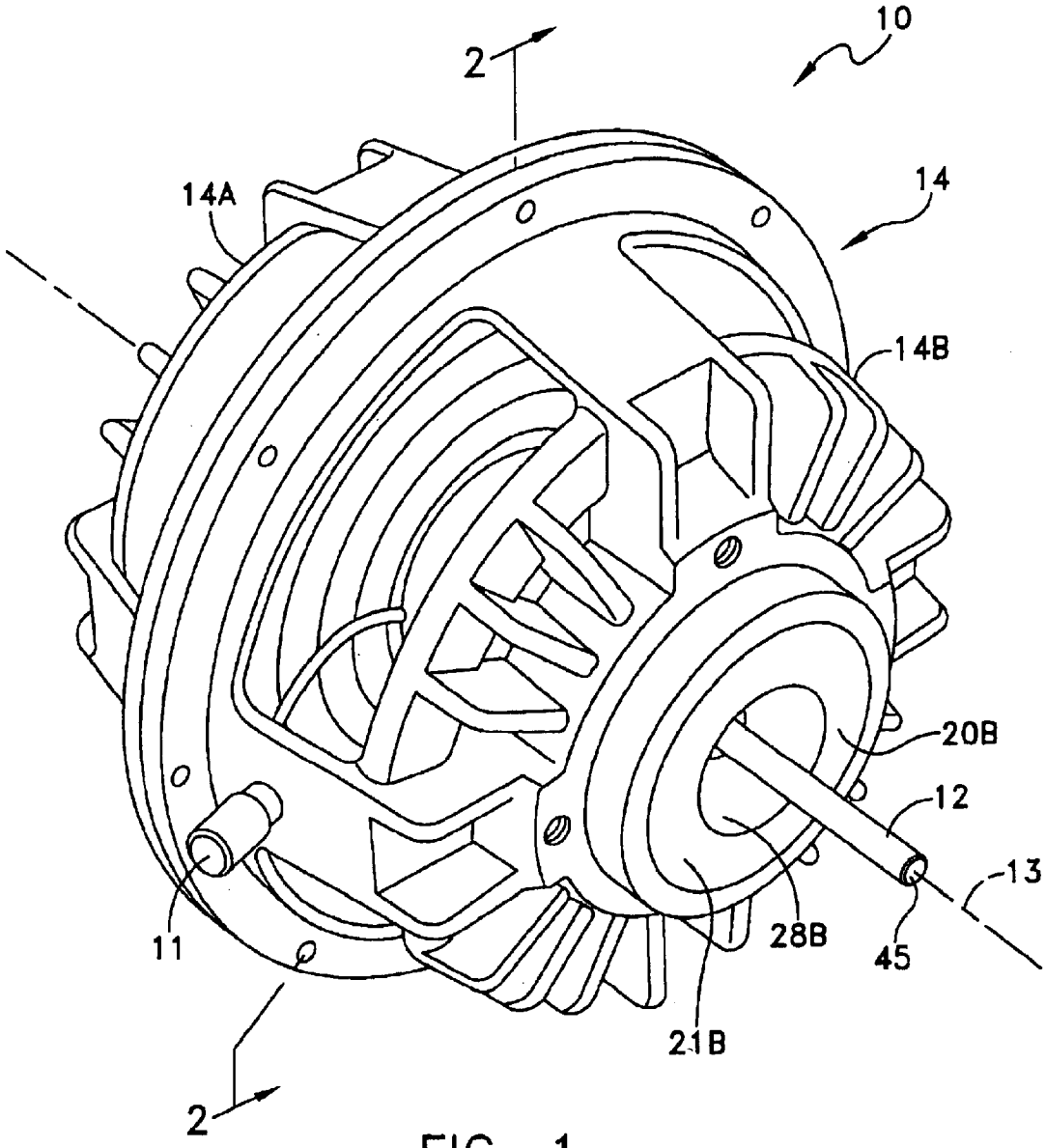
FIG. 1 is a perspective view of an assembled electromagnetic linear motor constructed in accordance with this invention.

FIG. 1 depicts a electromagnetic linear motor 10 constructed in accordance with this invention. The electromagnetic linear motor 10 converts an alternating current applied to input terminals, one input terminal 11 is shown, to a reciprocating motion of an output device represented by a drive rod 12 that extends along a motor axis 13.

Figure 2:
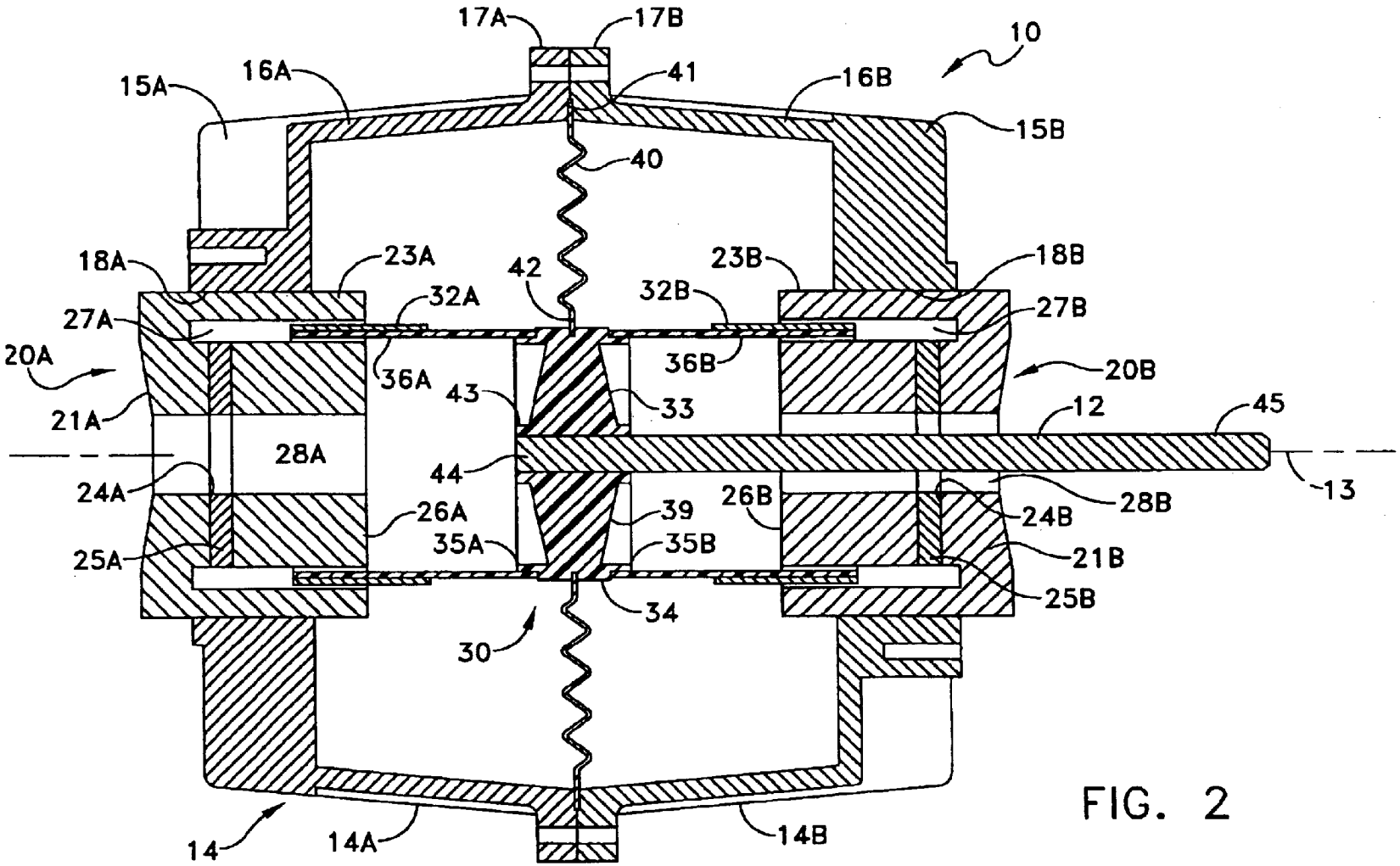
FIG. 2 is a cross-section taken along lines 2—2 in FIG. 1.
Figure 3:
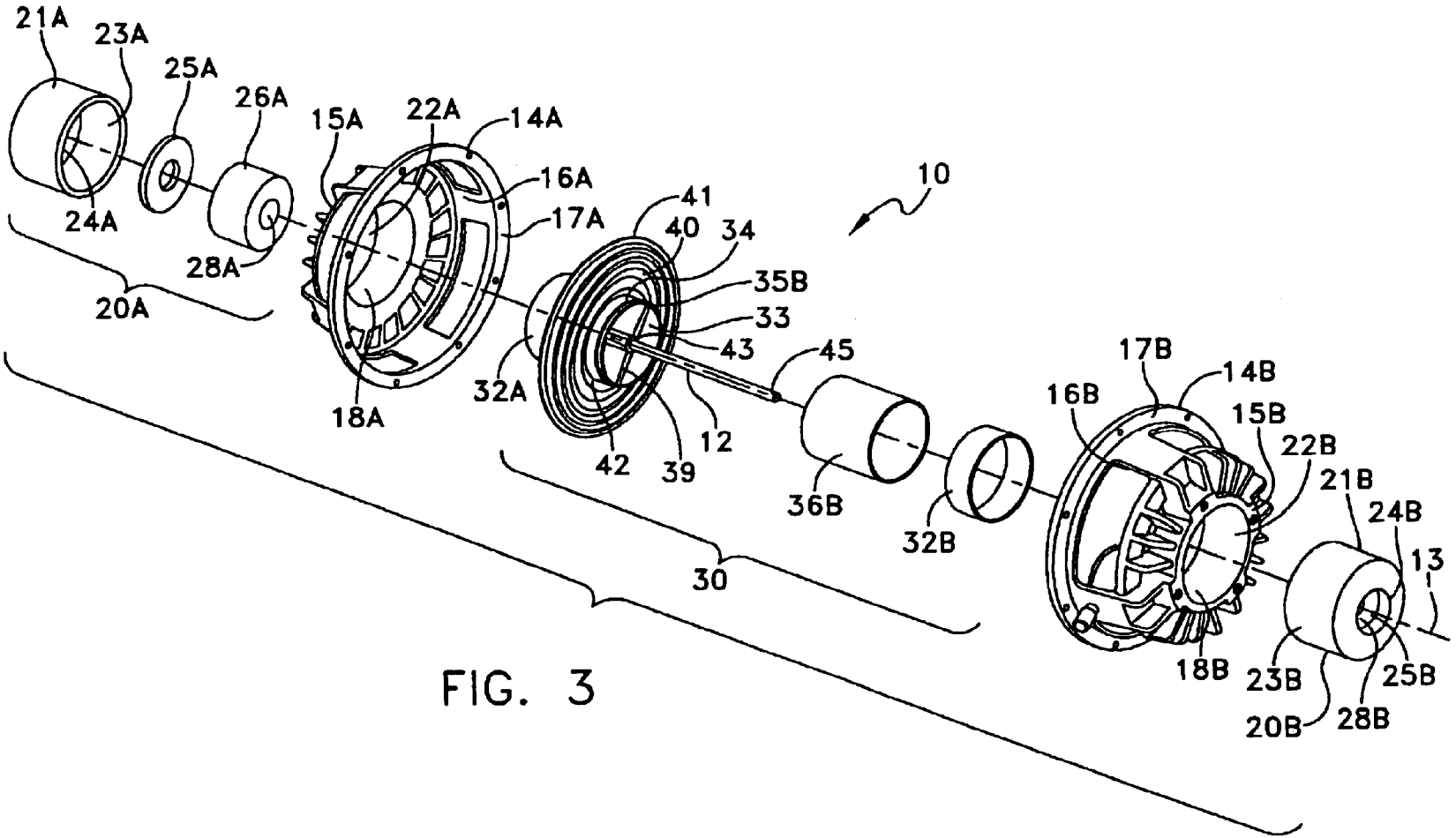
FIG. 3 is an exploded view of the electromagnetic linear motor shown in FIG. 1.

Referring to FIGS. 1 through 3, the electromagnetic linear motor 10 includes a two-piece motor frame 14 with first and second motor frame members 14A and 14B. In the following discussion it will become apparent that the electromagnetic linear motor 10 comprises two identical, but oppositely-facing assemblies. In the orientation of FIGS. 1 through 4, "A" designates an assembly or component on the left side of the figure; "B", the oppositely oriented, but corresponding assembly or component on the right side of the figure.

Referring to the motor frame member 14A in FIG. 2, an annular base 15A extends transversely to the motor axis 13. A wall 16A having a generally frusto-conical shape, extends axially to a flange 17A. The annular base 15A terminates in a cylindrical inner wall surface 18A centered on the motor axis 13. The identical, but oppositely facing, motor frame member 14B comprises a base 15B, a wall structure 16B, flange 17B and inner wall surface 18B.

By reference to FIG. 3, it will be apparent that each of the base structures 15A and 15B and the wall sections 16A and 16B can be defined by rib structures for heat dissipation and by spaced axially extending web structures for providing openings for air flow and reducing weight. FIG. 3 depicts a specific implementation. Variations of this implementation are well within the skill of electromagnetic linear motor designers.

The motor frame members 14A and 14B support first and second identically constructed, but counterfacing magnet structures 20A and 20B, respectively. The base 15A supports a cup-shaped annular pole piece 21A that can be press fit or otherwise attached to the base 15A such that it lies in a central opening 22A defined by the surface 18A. A cylindrical wall 23A of the annular pole piece 21A is concentric with the motor axis 13. An axially elevated platform 24A defines a transverse mounting surface for an annular permanent magnet 25A. Epoxy or another adhesive affixes the permanent magnet 25A to the base 21A. In a preferred embodiment the permanent magnet 25A is a rare earth permanent magnet, such as a neodymium permanent magnet. A cylindrical pole piece 26A affixed to the permanent magnet 25A, completes the magnet structure 20A.

The outer diameters of the permanent magnet 25A and second annular pole piece 26A are less than the inner diameter of the wall 23A thereby to form an axially extending annular magnetic air gap 27A. In addition, each of the pole pieces 21A and 26A and the permanent magnet 25A have an annular shape. Consequently the magnet structure 20A has a central passage 28A that lies on and along the motor axis 13. The magnet structure 20B comprises like components 21B through 26B in identical arrangement with an air gap 27B and a central passage 28B.

Thus, the motor frame 14 defines first and second spaced positions coextensive with the bases 15A and 15B and an intermediate position at the mating surfaces of the flanges 17A and 17B. The first and second annular magnet structures 20A and 20B attach to the motor frame 14 at the two axially spaced positions to define a first and second spaced, aligned, annular magnetic air gaps 27A and 27B that are counterfacing and that are concentric with the motor axis 13. Each magnet structure comprises a first annular pole piece supported by the corresponding frame member, such as the pole piece 21A, to define a radially outer surface of the air gap. One side of an annular permanent magnet, like the permanent magnet 25A, abuts the first pole piece 21A. An annular second pole piece 26A abuts the other side of the permanent magnet 25A and extends along the motor axis and forms an inner air gap surface.

The electromagnetic linear motor 10 also includes an armature that is concentric with the motor axis 13. In the particular embodiment shown in FIGS. 2 and 3, an armature 30 includes a bobbin structure 31 and axially spaced voice coils 32A and 32B. More specifically, the armature 30 includes a cylindrical central hub 33 with a central axially extending, circumferential outer body portion 34 with two cylindrical shoulders 35A and 35B at the opposite ends of the body portion 34. Oppositely extending cylindrical supports 36A and 36B, or bobbins, extend axially in opposite directions from the shoulders 35A and 35B, respectively. The opposite ends of the cylindrical supports 36A and 36B carry portions of the voice coils 32A and 32B in the respective air gaps 27A and 27B. The voice coils 32A and 32B connect electrically in series or parallel and to external electrical connections represented by the connection 11 shown in FIG. 1. The formation and connection of the voice coils to a source of alternating current signals is well known to those of skill in the art.

In accordance with this invention, a centering support in the form of a spider 40 establishes the neutral position and locates the armature 30 radially so the voice coils 32A and 32B reciprocate without contacting the pole pieces, such as the pole pieces 23A and 26A. The flanges 17A and 17B clamp an outer periphery 41 of the spider 40. An inner periphery 42 attaches the hub outer body portion 34 of the armature 30, so the spider 40 is located in a plane normal to the motor axis 13. As known, a spider is a circular piece of fabric or other material with multiple pleats. In the electromagnetic linear motor 10 the spider 40 acts like a spring that returns the voice coil back to its neutral or resting position. In addition, the spider 40 also constitutes an element for radially centering the voice coils 32A and 32B with respect to the motor axis 13A even during axial displacement from the neutral position.

The drive rod 12 transfers the reciprocating motion of the armature 30 to any output device that lies exteriorly to the frames 17A and 17B. The drive rod 12 constitutes a rigid link between the central hub 33 and and an output device. As will become apparent, the drive rod 12 also maintains the concentric relationship between the cylindrical supports 36A and 36B and motor axis 13.

More specifically, the central hub 33 includes a central cylindrical sleeve 43 that connects to the body portion 34 by means of angularly spaced radial arms 39. With this structure the central hub 33 is easily molded from plastics or other materials. The sleeve 43 receives one end 44 of the drive rod 12 that extends along the motor axis 13 to an opposite end 45 that is positioned outside the electromagnetic linear motor 10. FIG. 2 depicts a electromagnetic linear motor 10 with a single drive rod 12 extending to the right. As will now be apparent, a single drive rod could extend to the left of the electromagnetic linear motor 10 shown in FIG. 2. Alternatively the central hub 33 could carry two oppositely extending drive rods.

Figure 4:
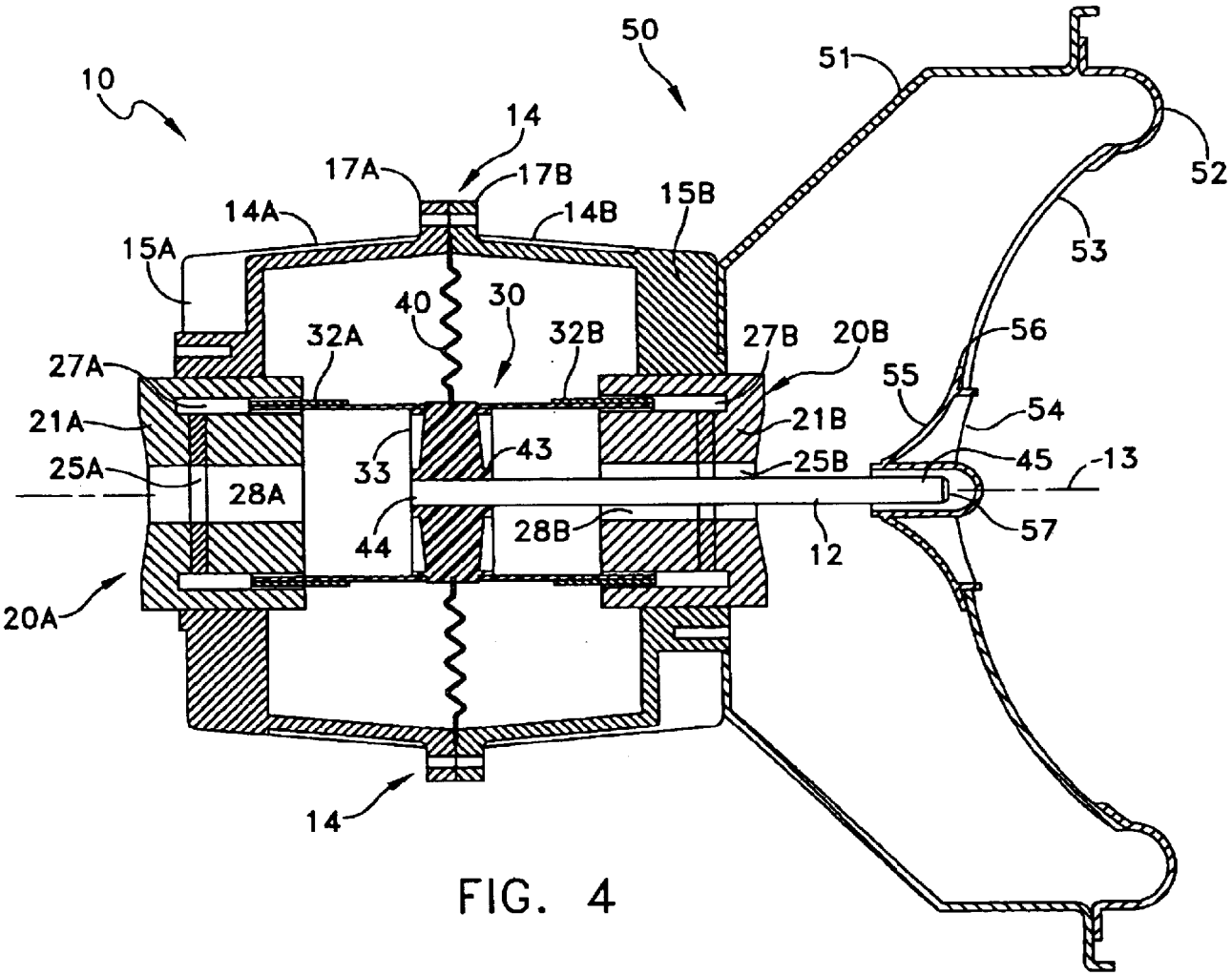
FIG. 4 is a cross-section of the electromagnetic linear motor of FIG. 1 for driving a loudspeaker.

FIG. 4 depicts the electromagnetic linear motor 10 as a driver for a loudspeaker 50 that includes a loudspeaker basket or frame 51. A surround 52 attaches an outer periphery of a speaker cone 53 to the loudspeaker frame 51 so the speaker cone is centered on and is transverse to the motor axis 13 and can be displaced along the motor axis 13. In this application the motor axis and loudspeaker axis are coincident so in the following discussion related to FIG. 4, the axis 13 is referred to as the loudspeaker axis.

In FIG. 4 the loudspeaker 50 includes an electromagnetic linear motor 10 with motor frames 14A and 14B that support the first and second magnet structures 20A and 20B with first and second annular air gaps 27A and 27B in a counterfacing, aligned relationship and centered on the loudspeaker axis 13. An armature 30 extends along the loudspeaker axis 13 and positions first and second voice coils 32A and 32B in the annular air gaps 27A and 27B respectively. The spider 40 constitutes a centering support that is transverse to the loudspeaker axis 13 and that is attached to the motor frame 14 between the motor frames 14A and 14B. The spider 40 centers the bobbin radially on the loudspeaker axis 13 and longitudinally along the loudspeaker axis 13. The drive rod 12 constitutes an axially rigid link that connects the armature 30, specifically the central hub 33 and the loudspeaker cone 53.

Loudspeaker cones can be annular in shape or can span the axis. In this particular embodiment, the loudspeaker cone 53 has a central portion in the form of a central opening that attaches to a fitting 54. The fitting 54 has a body 55 with an outer periphery 56 attached to the inner periphery of the speaker cone 53. The fitting 54 additionally includes a central cavity 57 that receives the end 45 of the drive rod 12. Adhesive or other means can be used to affix the end 45 in the cavity 57. Thus the drive rod 12 connects the central hub 33 and the loudspeaker cone 53 by means of the fitting 54 whereby alternating current applied to the voice coils 32A and 32B causes the loudspeaker cone 53 to undergo a corresponding displacement. Moreover, the armature 30 is constrained to motion along the loudspeaker axis 13 without radial displacement. In addition to the radial constraints provided by the spider 40, the speaker cone 53 and fitting 54 constrain any radial displacement of the drive rod 12 at its end 45. Such displacement, if were to occur, could skew the armature 30 with respect to the loudspeaker axis 13. With this structure, the centering action of the loudspeaker cone minimizes any such deflection and therefore minimizes any potential for skewing the armature 30 and voice coils 32A and 32B within the magnetic air gaps 27A and 27B.

Figure 5:
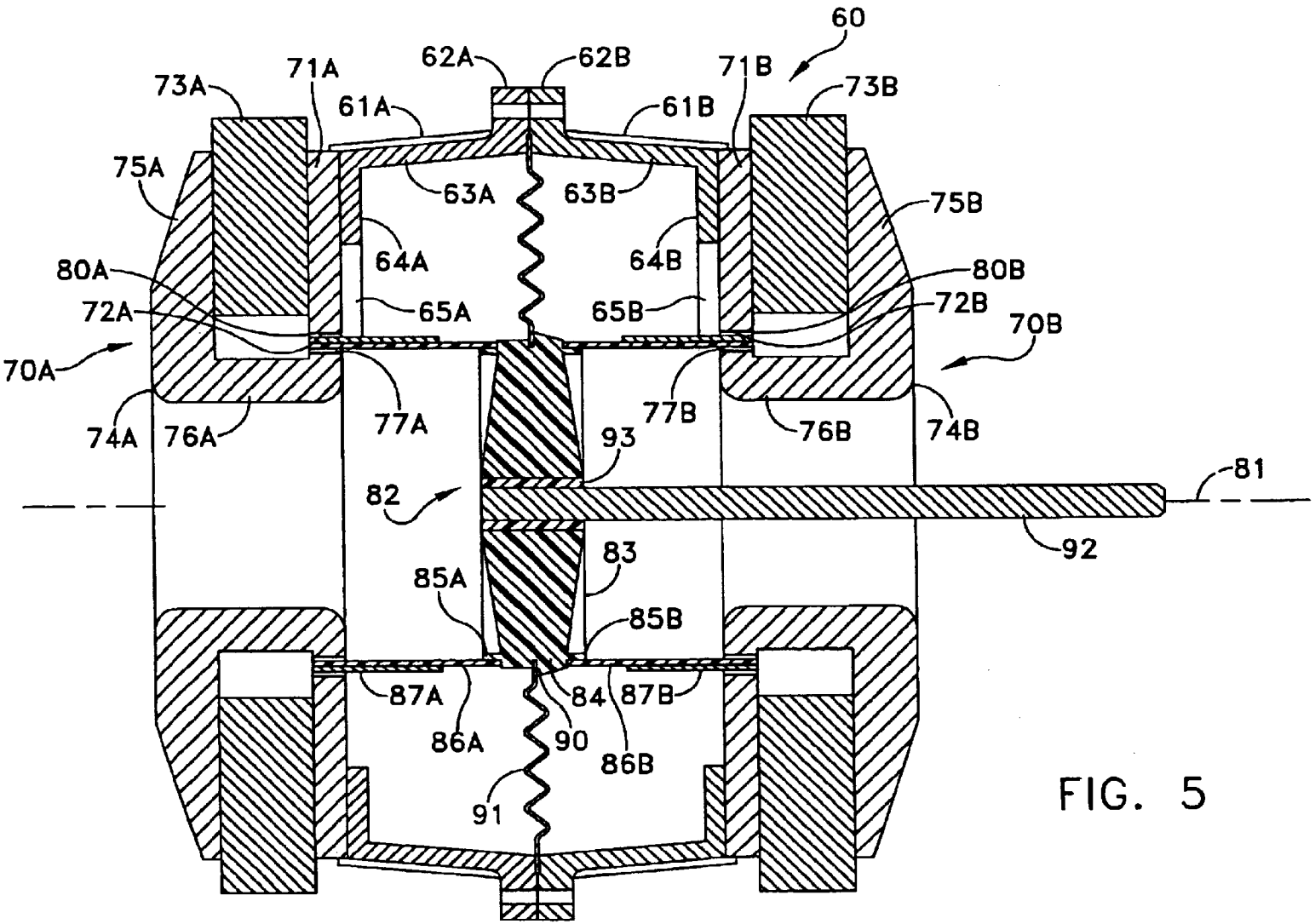
FIG. 5 is a cross-sectional view of an alternative embodiment of the electromagnetic linear motor of FIG. 1.

In FIGS. 2 through 4 the magnet assembly includes a permanent magnet located between the pole pieces and isolated from the exterior of the electromagnetic linear motor. FIG. 5 depicts an alternate version of the electromagnetic linear motor 60 that incorporates the basic concepts of this invention but with an external magnet. In this particular embodiment, two cup-shaped motor frame members 61A and 61B form a motor frame. Referring to the motor frame member 61A, an outer annular flange 62A mates with a corresponding flange 62B on the motor frame 61B. An offsetting portion 63A extends to an axially outer, radial mounting flange 64A that defines an annular opening 65A. The mounting flange 64A supports a magnet assembly 70A, particularly an annular, axially inner, pole piece 71A. A circumferential surface 72A defines one boundary of an annular magnetic air gap.

The first pole piece 71A carries an annular permanent magnet 73A that can be any of the ferrite or rare earth permanent magnet as previously described or even an electromagnet. A second, T-yoke pole piece 74A has first radially extending flange 75 that has a generally cylindrical shape and that abuts the surface of the magnet 73A. An axially extending leg 76A defines an annular extension that terminates with a slightly elevated cylindrical surface 77A that is radially inwardly spaced from the surface 72A to form the annular magnetic air gap 80A. Thus the magnet structure 70A defines the annular magnetic air gap 80A that is concentric with a central motor axis 81. The magnet assembly 70B has a similar structure, and FIG. 5 depicts those components with the same reference numbers as are applied to the magnet assembly 70A, substituting "B" for the suffix.

An armature 82 includes a central hub 83 with an outer circumferential, axially extending body portion 84. The body portion 84 has shoulders 85A and 85B for carrying oppositely extending supports or bobbins 86A and 86B, respectively. The cylindrical supports 86A and 86B carry voice coils 87A and 87B, respectively. The body portion 84 also has a radially extending shoulder 90 that attaches to the inner peripheral portion of a spider 91. The flanges 62A and 62B clamp the outer peripheral portion of the spider 91. A drive rod 92 attaches to a central hub 93 and extends along the motor axis 81.

Thus, like the electromagnetic linear motor 10 shown in FIGS. 2 through 4, the electromagnetic linear motor 60 produces reciprocal motion along a motor axis in response to alternating current signals. Moreover, the motor frames 61A and 61B constitute a structural frame in which the mounting flanges 64A and 64B define first and second spaced axial positions for establishing the magnetic air gaps 80A and 80B that are annular and concentric the motor axis 81. The armature 82 with the cylindrical supports or bobbins 86A and 86B and central hub 83 define an annular bobbin that carries voice coils, such as the voice coils 87A and 87B, at positions that produce interaction with the magnetic fields in the first and second magnetic air gaps 80A and 80B, respectively. A spider 91 constitutes a centering structure that attaches between the motor frame members 61A and 61B at the intermediate portion defined by the abutting surfaces of the flanges 62A and 62B. The flanges 62A and 62B also are positioned intermediate the first and second voice coils 87A and 87B. The spider 91 extends from the flanges 62A and 62B to the armature 82. Thus, the spider 91 constrains the armature 83 to reciprocal motion along the motor axis 81 in response to the receipt of alternating current signals in the first and second voice coils 87A and 87B.

Each of the electromagnetic linear motors disclosed in FIGS. 2 through 5 is a motor that optimizes efficiency particularly in manufacturing. In each embodiment duplicate parts are organized to produce the dual magnetic air gaps. There is a significant commonality of parts, and such a commonality can reduce the overall expenses of manufacture. It has also been found that with this approach significant excursions of the drive rods can be obtained. This is particularly important because each of the electromagnetic linear motors is readily adapted to operate with a loudspeaker, such as shown in FIG. 4.

Figure 6:
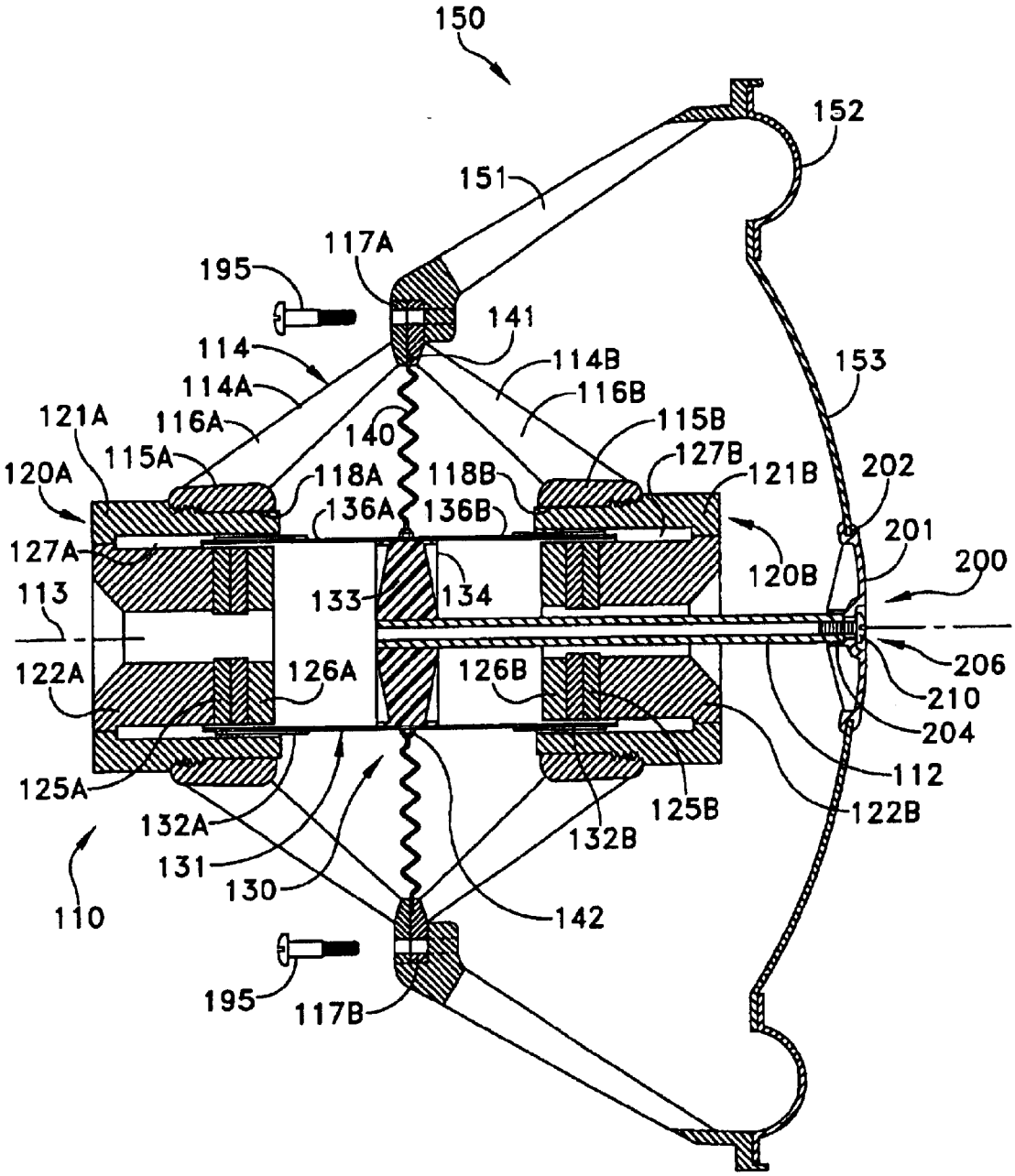
FIG. 6 is a cross-sectional view of another alternative embodiment of a loudspeaker utilizing a releasable coupling in accordance with this invention.

FIG. 6 depicts another loudspeaker embodiment that incorporates a releasable coupling to facilitate disassembly, repair and reassembly in accordance with this invention. In this embodiment a loudspeaker 150 includes an electromagnetic linear motor 110 with a two-piece motor frame 114 comprising first and second motor frame members 114A and 114B, using the designations "A" and "B" in the same fashion as they are used with reference to FIGS. 1 through 4

The motor frame member 114A in FIG. 6 has an annular base 115A that extends along to a motor axis 113. A wall 116A, having a generally frusto-conical shape, extends axially to a flange 117A. The annular base 115A terminates in a cylindrical inner wall surface 118A centered on the motor axis 113. The identical, but oppositely facing, motor frame member 114B comprises a base 115B, a wall structure 116B, flange 117B and inner wall surface 118B.

The motor frame members 114A and 114B support first and second identically constructed, but counterfacing magnet structures 120A and 120B, respectively. The base 115A supports an annular pole piece 121A that is threaded or otherwise held to the base 115A. A second pole piece 122A forms a return that is concentric with the motor axis 113 and forms a transverse mounting surface for an annular permanent magnet 125A. Epoxy or another adhesive affixes the permanent magnet 125A to the pole piece 122A. A flat cylindrical pole piece 126A affixed to the permanent magnet 125A completes the magnet structure 120A to define an annular magnetic air gap 127A that is concentric with the loudspeaker axis 113. The magnet structure 120B comprises like components 121B through 126B in opposed arrangement to form an annular air gap 127B.

An armature 130 is concentric with the motor axis 113 and includes a bobbin structure 131 and axially spaced voice coils 132A and 132B. A cylindrical central hub 133 has a central axially extending, circumferential outer body portion 134 with two cylindrical shoulders. The bobbin structure 131 includes oppositely extending cylindrical supports 136A and 136B supported from the central hub 133. The opposite ends of the cylindrical supports 136A and 136B carry the voice coils 132A and 132B in the respective air gaps 127A and 127B. The voice coils 132A and 132B connect electrically in series or parallel and to external electrical connections as represented by the connection 11 shown in FIG. 1.

A centering support in the form of a spider 140 establishes the neutral position and locates the armature 130 radially so the voice coils 132A and 132B reciprocate without contacting the pole pieces that form the air gaps 127A and 127B. The flanges 117A and 117B clamp an outer periphery 141 of the spider 140. An inner periphery 142 attaches to the central hub 133 so the spider 140 is located in a plane normal to the motor axis 113.

In FIG. 6, the electromagnetic linear motor 110 is a driver for the loudspeaker 150 that includes a loudspeaker basket or frame 151. A surround 152 attaches an outer periphery of a speaker cone 153 to the loudspeaker frame 151 so the speaker cone is centered on and is transverse to the motor axis 113 an can be displaced along the axis 113.

Figure 7:
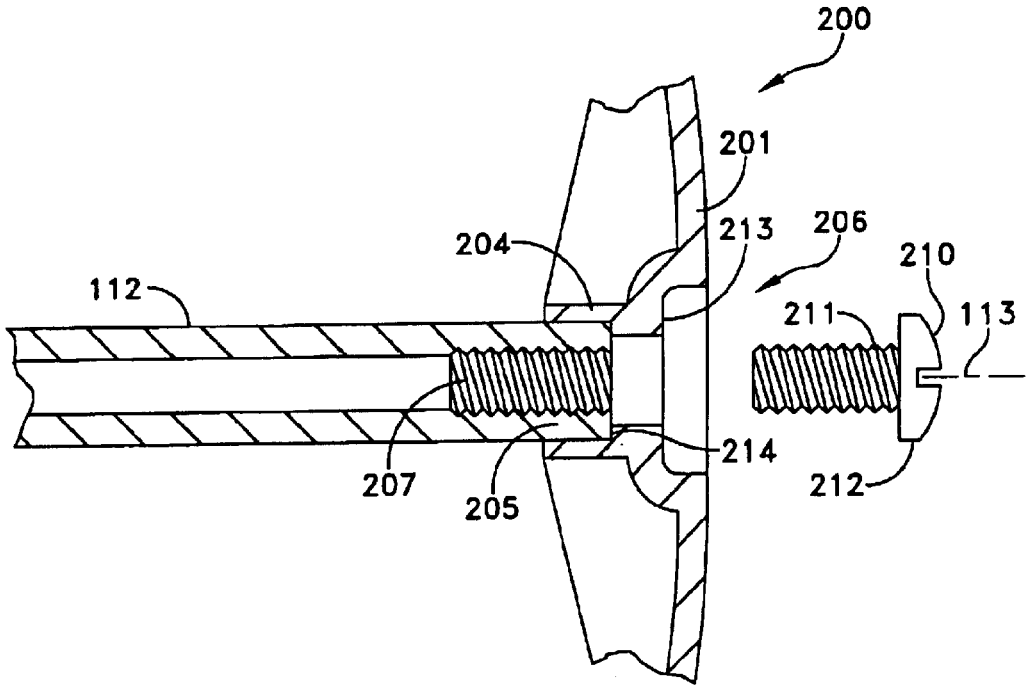
FIG. 7 is an enlarged detailed view of the releasable coupling shown in FIG. 6.

Loudspeaker cones can be annular in shape or can span the axis. In this particular embodiment, the loudspeaker cone 153 has a central portion in the form of a central opening that attaches to a fitting 200. Referring to FIGS. 6 and 7, the fitting 200 has a body 201 with an outer periphery 202 attached to the inner periphery of the speaker cone 153. The fitting 200 additionally includes a central hub 204 that receives an end 205 of the drive rod 112. The drive rod 112 connects to the fitting 200 by means of a releasable coupling 206. The drive rod 112 is fixed to the armature 130 in this embodiment.

Referring now to FIG. 7, the releasable coupling 206 includes an internally threaded end portion 207 in the end 205 of the drive rod 122. A machine screw 210 with an externally threaded portion 211 can be tightened into the internal threads 207 until a head 212 engages a countersunk surface 213 and the end of the drive rod 112 tightens against an internal shoulder 214. Thus the releasable coupling 206 includes an internally threaded portion of the rigid link 112 and a complementary externally threaded fastener in the form of the machine screw 210.

As will now be shown, this structure facilitates the repair of a failed component such as a voice coil. After the loudspeaker is removed from its enclosure as a complete assembly, the machine screw 210 shown in FIG. 6 is removed as shown in FIG. 7. The spider 140 prevents any rotation of the drive rod 112 during this operation. Thereafter all the mounting bolts, such as mounting bolts 195, that attach the flange peripheries 117A and 117B to the motor frame 151 can be removed. The motor frames 114A and 114B can then be moved axially away from the basket 151 and separated to expose the voice coils 132A and 132B. Next the armature 130 with the voice coils 132A and 132B and the drive rod 112 with the spider 140 can be moved as a subassembly axially, i.e., to the left in FIG. 6.

Adhesive at the inner periphery of the voice coil bobbins 136A and 136B could be removed to separate the individual voice coil bobbins from the armature structure 130 and thereby permit the replacement of the voice coils. Alternatively the entire subassembly including the voice coils 132A and 132B, the armature 130, the spider 140, and the drive rod 112 might be replaced as a pre-manufactured subassembly.

When a new subassembly is available, the subassembly is reinserted and temporarily supported by an alignment bushing that carries the drive rod in the center of the magnetic pole piece 122B, positioning the assembly to obtain proper radial alignment. Then the motor frames 114A and 114B are reattached to each other by a pair of small threaded fasteners at the frame periphery, clamping the spider to maintain alignment of the voice coils 132A and 132B in their magnetic air gaps 127A and 127B. Once the spider is clamped, the alignment bushing may be removed and the entire motor structure may be assembled to the loudspeaker frame by the fasteners 195. The releasable coupling is completed by the threading of screw 210 into the end of the rigid link 112 as shown in FIG. 6.

It will now be apparent that this process is simple to undertake. The releasable coupling 206 allows the rigid link to be detached from the loudspeaker cone, one of the two places where the rigid link needs to be affixed.

Figure 8:
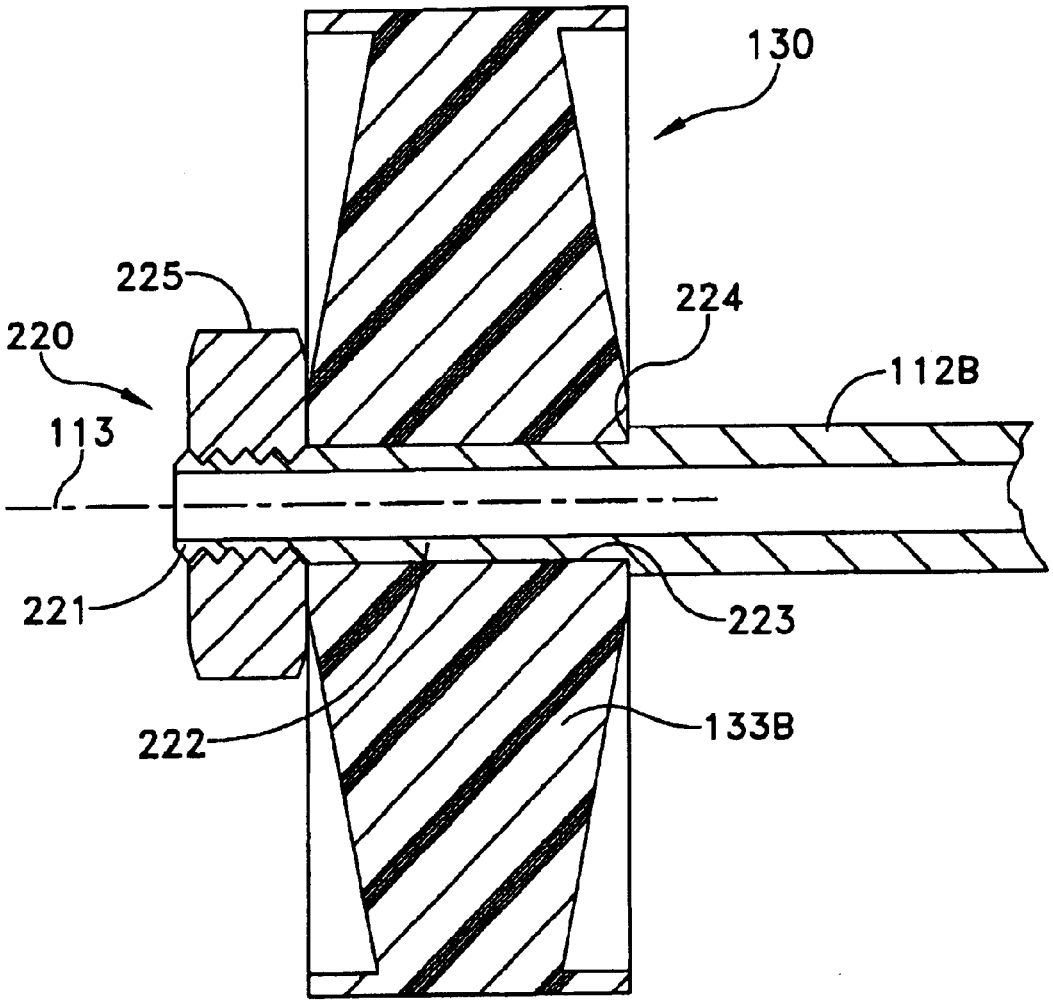
FIG. 8 is an enlarged detailed view of an alternative embodiment of a releasable coupling.

It is also possible to substitute a releasable coupling for the fixed connection at the other end of the rigid link thereby to provide a releasable coupling where the rigid link 112 joins the armature 130. In FIG. 8, a drive link 112B is modified to include a releasable coupling 220 with an externally threaded end portion 221 at the end of a shank portion 222 that passes through a central passage 223 in the armature. A radial shoulder 224 in the rigid link 112B provides a bearing surface against the hub 133B. The releasable coupling between the rigid link 112B and the armature 130 is completed by advancing a nut 225 over the threaded end portion 221 until the rigid link 112B firmly clamps within the hub 133B. Thus this example of a releasable coupling 220 includes an externally threaded portion of the rigid link 112B and a complementary internally threaded fastener, such as the nut 225.

As other variations, a given speaker may include a releasable coupling at both of the armature and loudspeaker cone ends of the rigid link. Each releasable coupling may have the same general construction or a different construction. For example, one releasable coupling could include an internally threaded portion of the rigid link and a complementary externally threaded fastener, or an externally threaded portion of a rigid link and a complementary internally threaded fastener. In whatever form, it will now be apparent that the use of one or more releasable couplings shown in FIGS. 6 through 8 or other forms of such a coupling will facilitate the repair of an electromechanical linear motor. This invention can be applied to any number of electromechanical linear motors and loudspeaker systems, but is particularly adapted for facilitating the repair and service of an electromechanical linear motor and loudspeaker with dual magnetic air gaps and dual voice coils that operate with high power and provide long linear excursions.

As will now be apparent, many variations and modifications could be made to the specifically disclosed embodiments of FIGS. 1 through 8, particularly of FIGS. 6 through 8 without departing from the spirit and scope of this invention. Different forms of releasable couplings using fasteners other than threaded connections could still perform the required coupling functions. Therefore, it is the intent of the appended claims to cover all such variations and modifications as come within the true spirit and scope of this invention.

What is claimed as new and desired to be secured by Letters Patent of the United States is:

1. A loudspeaker comprising:

A) a loudspeaker basket,

B) a loudspeaker cone suspended from said loudspeaker basket for displacement along a loudspeaker axis, B) first and second magnet structures that define first and second annular magnetic air gaps, respectively C) a motor frame supporting said first and second magnet structures on the loudspeaker frame with the first and second annular magnetic air gaps in a counterfacing relationship and centered on the loudspeaker axis, D) first and second voice coils for being energized by alternating current signals, E) an armature extending along the loudspeaker axis and supporting said first and second voice coils in the first and second annular magnetic air gaps, respectively, F) a centering support transverse to the loudspeaker axis and attached to said motor frame and said armature for centering said armature radially on the loudspeaker axis during axial displacement of said armature along the axis, and G) a rigid link connecting said armature and said loudspeaker cone whereby alternating current applied to said first and second voice coils causes said loudspeaker cone to undergo a corresponding displacement and said armature is constrained to axial motion without radial displacement with respect to the loudspeaker axis.

2. A loudspeaker as recited in claim 1 wherein said motor frame includes first and second frames centered on the loudspeaker axis and extending generally transversely thereto and wherein each of said first and second magnet structures includes:

i) a first, annular pole piece supported by said motor frame to define a radially outer surface of the corresponding magnetic air gap, ii) an annular permanent magnet having one side in abutment with said first pole piece, and iii) an annular second pole piece with one surface in abutment with the other side of said annular permanent magnet, a surface of the said second pole piece forming an inner circumferential surface of the corresponding magnetic air gap.

3. A loudspeaker as recited in claim 2 wherein each said annular permanent magnet comprises a ferrite permanent magnet.

4. A loudspeaker as recited in claim 2 wherein each said annular permanent magnet comprises a rare earth permanent magnet.

5. A loudspeaker as recited in claim 2 wherein said armature comprises first and second cylindrical supports for supporting said first and second voice coils, respectively, and a central hub transverse to and centered on the loudspeaker axis for supporting said first and second cylindrical supports on opposite sides of said hub and centered on the loudspeaker axis, said rigid link being connected between said hub and said loudspeaker cone and said centering structure including a spider with an outer periphery attached to said motor frame at the intermediate position and an inner periphery attached to said armature whereby said spider constrains said armature and rigid link to motion along the loudspeaker axis in a radially constant position and said rigid link maintains the voice coils concentric with the loudspeaker axis.

6. A loudspeaker as recited in claim 5 wherein said loudspeaker cone has an outer periphery and a central portion and wherein a surround attaches said outer periphery to said loudspeaker basket and said rigid link connects to the central portion of said loudspeaker cone.

7. A loudspeaker as recited in claim 1 wherein said armature comprises first and second cylindrical supports for supporting said first and second voice coils, respectively, and a central hub transverse to and centered on the loudspeaker axis for supporting said first and second cylindrical supports on opposite sides of said hub and centered on the loudspeaker axis, said rigid link being connected between said hub and said loudspeaker cone and said centering structure including a spider with an outer periphery attached to said motor frame at the intermediate position and an inner periphery attached to said armature whereby said spider constrains said armature and rigid link to motion along the loudspeaker axis in a radially constant position and said rigid link maintains the voice coils concentric with the loudspeaker axis.

8. A loudspeaker as recited in claim 7 wherein said loudspeaker cone has an outer periphery and a central portion and wherein a surround attaches said outer periphery to the loudspeaker basket and said rigid link includes a connector affixed to said central portion of said loudspeaker cone.

9. A loudspeaker as recited in claim 7 wherein the attachment of said rigid link to one of said armature and loudspeaker cone includes a releasable coupling and to the other of said armature and loudspeaker cone includes a permanent connection.

10. A loudspeaker as recited in claim 9 wherein said releasable coupling includes an internally threaded portion of said rigid link and a complementary externally threaded fastener.

11. A loudspeaker as recited in claim 9 wherein said releasable coupling includes an externally threaded portion of said rigid link and a complementary internally threaded fastener.

12. A loudspeaker as recited in claim 7 wherein first and second releasable couplings attach the opposite ends of said rigid link to said armature and loudspeaker cone, respectively.

13. A loudspeaker as recited in claim 12 wherein one of said releasable couplings includes an internally threaded portion of said rigid link and a complementary externally threaded fastener.

14. A loudspeaker as recited in claim 12 wherein one of said releasable couplings includes an externally threaded portion of said rigid link and a complementary internally threaded fastener.

15. A loudspeaker as recited in claim 1 wherein said first and second voice coils are electrically interconnected.

16. A loudspeaker as recited in claim 1 wherein said centering structure includes a central hub and a spider with an outer periphery attached to said motor frame at an intermediate position and an inner periphery attached to said hub whereby said spider constrains said armature and rigid link to motion along the loudspeaker axis in a radially constant position and said rigid link maintains the voice coils in a concentric relationship with respect to the loudspeaker axis.

17. A loudspeaker as recited in claim 1 wherein said loudspeaker cone has an outer periphery and a central portion and wherein a surround attaches said outer periphery to the loudspeaker basket and said rigid link is affixed to said central portion of said loudspeaker cone.

18. A loudspeaker as recited in claim 17 wherein the attachment of said rigid link to one of said armature and loudspeaker cone includes a releasable coupling and to the other of said armature and loudspeaker cone includes a permanent connection.

19. A loudspeaker as recited in claim 18 wherein said releasable coupling includes an internally threaded portion of said rigid link and a complementary externally threaded fastener.

20. A loudspeaker as recited in claim 18 wherein said releasable coupling includes an externally threaded portion of said rigid link and a complementary internally threaded fastener.

21. A loudspeaker as recited in claim 17 wherein first and second releasable couplings attach the opposite ends of said rigid link to said armature and loudspeaker cone, respectively.

22. A loudspeaker as recited in claim 21 wherein one of said releasable couplings includes an internally threaded portion of said rigid link and a complementary externally threaded fastener.

23. A loudspeaker as recited in claim 21 wherein one of said releasable couplings includes an externally threaded portion of said rigid link and a complementary internally threaded fastener.

* * * * *